United States Patent [19]

Matsunaga et al.

[11] 4,331,942

[45] May 25, 1982

[54] STRIPLINE DIODE PHASE SHIFTER

[75] Inventors: Makoto Matsunaga; Akihito Mizobuchi, both of Kamakura, Japan

[73] Assignee: Mitsubishi Denki Kabushiki Kaisha, Tokyo, Japan

[21] Appl. No.: 93,960

[22] Filed: Nov. 14, 1979

[30] Foreign Application Priority Data

Nov. 15, 1978 [JP] Japan ..... 53-140591

[51] Int. Cl.[3] ..... H01P 1/185

[52] U.S. Cl. ..... 333/161; 333/35; 333/246

[58] Field of Search ..... 333/156, 34–35, 333/160–162, 101, 103–104, 117–120, 262, 258, 246, 247; 343/854

[56] References Cited

U.S. PATENT DOCUMENTS

| | | | |
|---|---|---|---|
| 3,571,765 | 3/1971 | Friedman | 333/164 |
| 3,996,533 | 12/1976 | Lee | 333/161 X |
| 4,088,970 | 5/1978 | Fasset et al. | 343/854 X |
| 4,205,282 | 5/1980 | Gipprich | 333/164 X |

FOREIGN PATENT DOCUMENTS

| | | | |
|---|---|---|---|
| 2750382 | 5/1978 | Fed. Rep. of Germany | 333/161 |

OTHER PUBLICATIONS

White–"Diode Phase Shifters for Array Antennas", IEEE Transactions on Microwave Theory and Techniques, vol. MTT-22, No. 6, Jun. 1974; pp. 658–674.

*Primary Examiner*—Marvin L. Nussbaum

*Attorney, Agent, or Firm*—Sughrue, Mion, Zinn, Macpeak & Seas

[57] ABSTRACT

A stripline diode phase shifter in which plural hybrid couplers, one for each stage, are connected in series with one another with no bias blocking means disposed between the hybrid couplers to thereby eliminate much loss and unwanted reflections. At least one DC cut is coupled between each of hybrid couplers and a diode loading line. A PIN diode is coupled to a second terminal of the diode loading line. The diode loading line is constructed as a $\lambda/4$ impedance conversion line section and a diode loading line section coupled in series with the length of the diode loading line section being set such that the phase of reflection voltage from the diode is equal in magnitude but different in sign at the connecting point of the diode loading line section and the $\lambda/4$ impedance conversion line section.

5 Claims, 8 Drawing Figures

FIG. 6(A)
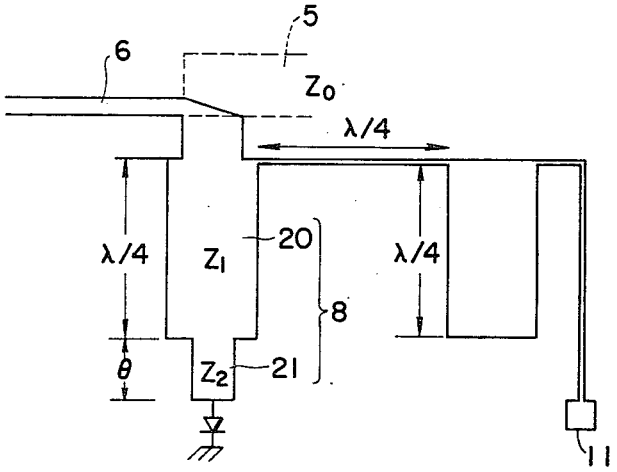
FIG. 6(C)
FIG. 6(B)
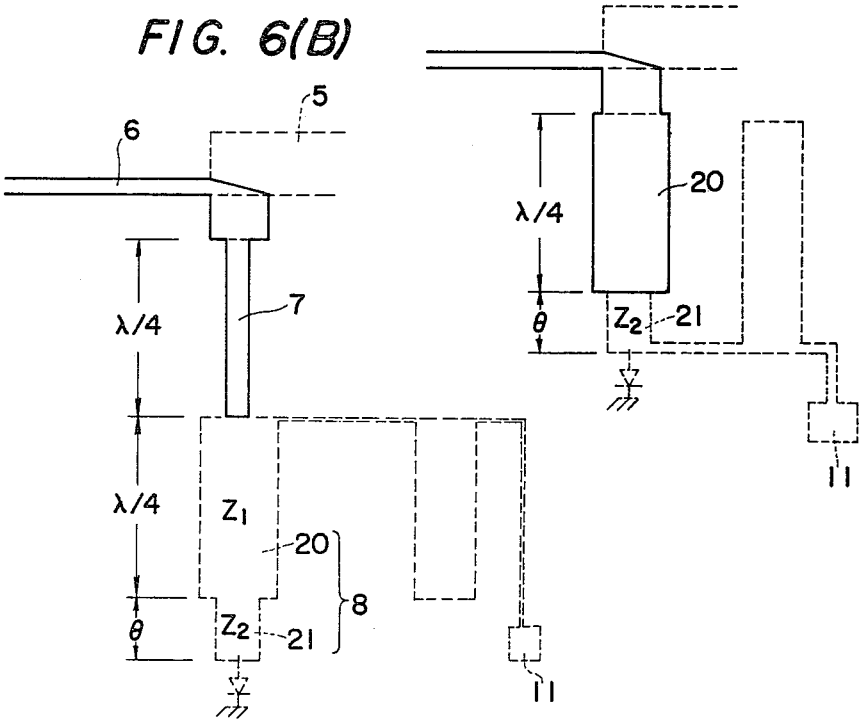

STRIPLINE DIODE PHASE SHIFTER

BACKGROUND OF THE INVENTION

This invention relates to diode phase shifters implemented with striplines. More specifically, the invention relates to a stripline diode phase shifter which has a low line loss and is miniaturized.

Conventional hybrid couplers employ first and second juxtaposed hybrid coupling line conductors with an input signal applied to one end of one conductor and an output signal taken from the far end of the other conductor. Thus, for example, the left-most hybrid coupler 6 in FIG. 1 includes a lower conductor which receives an input signal at its left end and an upper conductor which provides an output at its right end. If the coupling between upper and lower conductors is weak, the input signal will be transmitted down to the right end of the lower conductor, which is referred to as a transmitting terminal. If the coupling between upper and lower conductors is strong, the signal will be split into two parts with one part appearing at the transmitting terminal and the other part being coupled over to the left end of the upper conductor, which is therefore referred to as the coupling terminal. The signals at the transmitting and coupling terminals will be 90 out-of-phase, and the coupled signal will travel down to the output terminal. The amount of phase shift provided by the coupler is typically controlled by connecting phase-shifting diodes to the coupling and transmitting terminals and varying the bias applied to the diodes. Thus, these coupling and transmitting terminals may also be referred to as phase-shifting terminals.

In general, plural diode phase shifters are cascade-connected so as to provide a multi-bit phase shifter. FIG. 1 is a schematic circuit diagram of a conventional 3-bit stripline diode phase shifter. In FIG. 1, an electromagnetic wave applied to a main line 5 from an RF input terminal passes through a DC cut or block 7 which blocks a DC bias component and permits the passage of only RF components thereby isolating the DC bias from one another and from the external circuit. The DC cut 7 is a wide bandpass filter which is constructed such that the coupling terminal and the transmitting terminal of a coupling line-type hybrid having a length corresponding to a $\frac{1}{4}$ wavelength are open and that at a frequency near its designed center frequency, the characteristic impedance of the D.C. cut is equal to the characteristic impedance of a hybrid 6. Thus, the DC cut 7 is formed as a quarter-wave hybrid coupler whose length is equal to a $\frac{1}{4}$ wavelength. Thereafter, the electromagnetic wave passing through the DC cut 7 is applied to a hybrid 6 which acts as a 180° phase shifter and is then transmitted to the main line 5 on the output side through further DC cuts 7, a 90° phase shifter and a 45° phase shifter in succession. Each of the phase shifters is operated by switching the polarity of a DC bias applied to its corresponding bias circuit 9 and the DC biases are isolated from one another by DC cuts 7 as described above.

As is well known in the art, phase shifting circuits of this type are formed by printing stripline conductors on opposite surfaces of a substrate and then placing dielectric layers over each of the printed circuits. Finally, ground layers are disposed over each of the outer dielectric layers. The resulting structure consists, in order, of ground, dielectric, printed circuit, dielectric, printed circuit, dielectric, and ground layers, with the center dielectric being referred to as the "intermediate layer substrate" in the present application.

FIG. 6(A) shows a diode loading line which is provided on the intermediate layer substrate of the phase shifter. As is shown in FIG. 6(A), the diode loading line includes a $\lambda/4$ impedance conversion line section 20 and a diode loading line section 21, the respective impedances $Z_1$ and $Z_2$ of which are so designed that a desired amount of phase shift is provided and that the difference in loss is minimized when the bias is switched. Furthermore, in FIG. 6(A), the length $\theta$ of the diode loading line section 21 is so selected that at the connecting point of the diode loading line section 21 and the $\lambda/4$ impedance conversion line section 20 the phase of reflection voltage from the diode is equal in magnitude but different in sign when the bias applied to the diode is switched.

The above-described conventional stripline diode phase shifter is advantageous in that a wide band characteristic can be obtained. However, it is disadvantageous in that, since the hybrids 6 and the DC cuts 7 are alternately cascade-connected as illustrated in FIG. 1, reflections are quite high in the main line, the loss is correspondingly increased, and the overall longitudinal dimension of the device is necessarily long.

SUMMARY OF THE INVENTION

Accordingly, an object of this invention is to eliminate all of the above-described difficulties accompanying a conventional stripline diode phase shifter.

Another object of the invention is to provide a stripline diode phase shifter which has a reduced line loss, excellent reflection characteristics and is smaller in size than the prior art devices.

In accordance with this object, there is provided a stripline diode shifter including a plurality of diodes such as PIN diodes and a first plurality of hybrid couplers for separating bias and a second plurality of hybrid couplers for distributing electric power wherein the hybrids for separating bias are connected between corresponding ones of the diodes and corresponding ones of the hybrid couplers for distributing electric power.

Further in accordance with the objects of the invention, there is provided a stripline diode phase shifter including at least one phase shift section having a coupling line-type hybrid coupler with a coupling terminal and a transmitting terminal, a coupling line section, and a diode. The diode is connected to the coupling terminal and the transmitting terminal through the coupling line section. The dimensions of the coupling line sections are determined in accordance with impedance characteristics of the diode such that the coupling terminal and the transmitting terminal are effectively open circuited. A multi-bit phase shifter can be provided by coupling plural ones of such sections in cascade.

Yet further in accordance with the objects of the present invention, there is provided a stripline diode phase shifter including a plurality of hybrid couplers connected in series with one another with no separate bias blocking means disposed therebetween, at least one DC cut means having a first terminal coupled to each of the hybrid couplers, and a diode loading line coupled between a second terminal of the DC cut means and a diode. The diode loading line preferably is constructed as a $\lambda/4$ impedance conversion line section and a diode loading line section connected in series. The length of the diode loading line section is determined such that at the connecting point of the diode loading line section 21 and the λ/4 impedance conversion line section 20, the phase of reflection voltage from the diode is equal in magnitude but different in sign from the phase of the reflection voltage when the bias applied to the diode is switched.

The foregoing objects and other objects as well as the characteristic features of the present invention will become more apparent from the following detailed description and the appended claims when read in conjunction with the accompanying drawings in which like parts are designated by like reference numerals.

BRIEF DESCRIPTION OF THE DRAWINGS

In the accompanying drawings:

FIG. 6(A) is a plan view showing a diode loading line employed in the conventional stripline diode phase shifter shown in FIG. 1 wherein components in solid lines are on top of a dielectric substrate, and components in dotted lines are disposed on the bottom of a dielectric substrate;

FIG. 6(B) is a plan view showing a DC cut and a diode loading line formed on the intermediate layer substrate of the first example of the phase shifter shown in FIGS. 2 to 4 wherein components in solid lines are on top of a dielectric substrate, and components in dotted lines are disposed on the bottom of a dielectric substrate; and FIG. 6(C) is a plan view showing the second example of the stripline diode phase shifter shown in FIG. 5 wherein components in solid lines are on top of a dielectric substrate, and components in dotted lines are disposed on the bottom of a dielectric substrate.

DETAILED DESCRIPTION OF THE INVENTION

Figure 1:
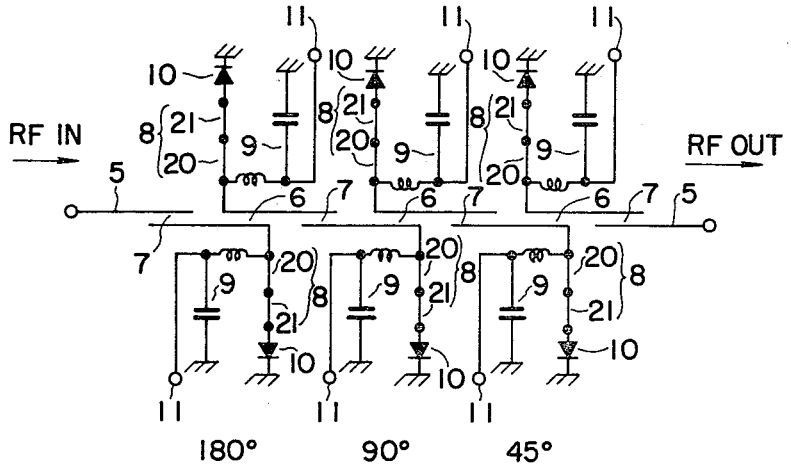
FIG. 1 PRIOR ART
FIG. 1 is a schematic circuit diagram showing a conventional 3-bit stripline diode phase shifter of the prior art.
Figure 2:
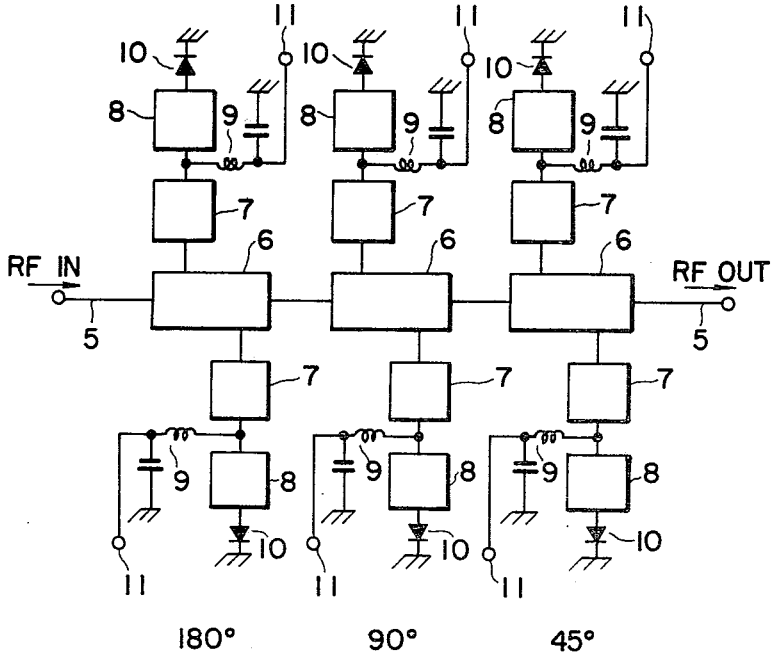
FIG. 2 is a block schematic diagram showing a first example of a stripline diode phase shifter according to the present invention.

A first example of a stripline diode phase shifter according to the invention is shown in FIG. 2. One of the specific features of the invention resides in that a DC cut 7 as shown in FIG. 1 is provided between each hybrid 6 and each diode loading line 8. More specifically, each DC cut 7 is connected to the coupling terminal and the transmitting terminal of the hybrid 6, and the DC cut 7 is connected to a PIN diode 10 through a diode loading line 8 which is so designed as to provide a desired amount of phase shift. In order to apply a bias to the PIN diode 10, a bias circuit 9 is connected to the connecting point of the DC cut 7 and the diode loading line 8. The diode loading line 8 is so designed that when the bias applied to the PIN diode 10 is switched, the phase difference of a wave reflected toward the hybrid 6 is at a desired value at the connecting point of the DC cut 7 and the diode loading line 8.

Figure 3:
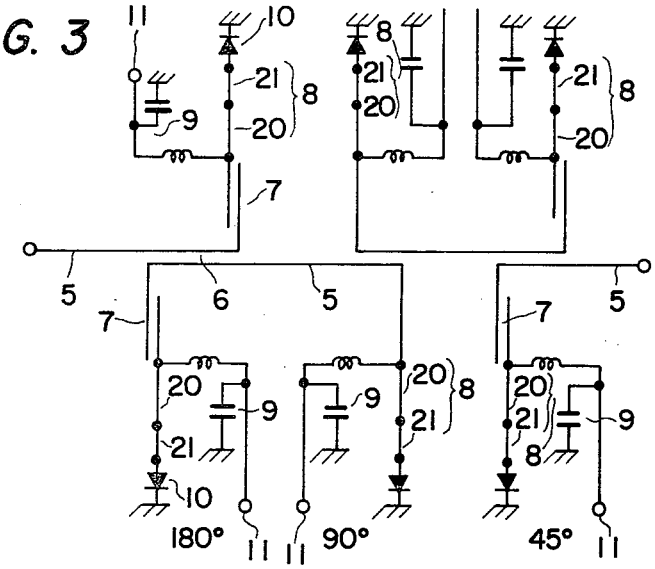
FIG. 3 is a circuit diagram used for a description of the operation of the phase shifter shown in FIG. 2.

FIG. 3 is a circuit diagram for a description of the operation of the first example of the stripline diode phase shifter shown in FIG. 2. An electromagnetic wave applied to the main line 5 from an RF input is transmitted to the hybrid 6 which provides a 180° phase shift. The power of the wave is divided into two parts which appear respectively at the transmitting terminal and the coupling terminal to which the DC cut 7 is connected. The DC cut 7 is further connected to the diode loading line 8. Thus, DC biases applied to the PIN diodes 10 are isolated from one another in the bit phase shifters. The DC cuts 7 inserted as described above are completely independent of the reflection characteristics of the individual phase shifters. Therefore, the circuit arrangement of the first example of the stripline diode phase shifter can reduce the magnitude of reflection more than that of the conventional device in which four DC cuts 7 in total are series-connected between the individual phase shifters and between the external circuit and the phase shifter.

The necessary number of DC cuts 7 with a phase shifter of the invention is only two per phase shift section and the construction of each DC cut is the same as that in the conventional device. It is appreciated that, nevertheless, a low reflection characteristic can be obtained.

Figure 4:
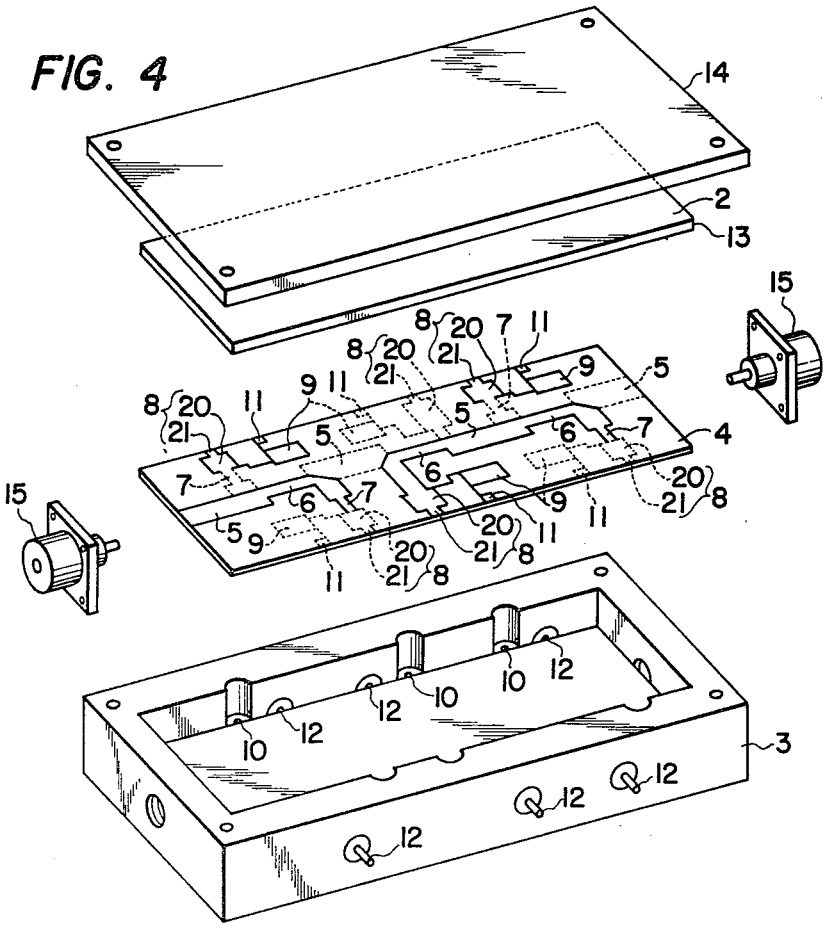
FIG. 4 is a diagram showing a complete assembly of a 3-bit phase shifter according to the first example shown in FIG. 2.

FIG. 4 shows a typical example of a 3-bit phase shifter assembly utilizing the first example of the stripline diode phase shifter of the invention. FIG. 6(B) is an enlarged view showing the DC cut 7 and the diode loading line 8 more clearly which are formed on the intermediate layer substrate by photoetching.

As is apparent from FIGS. 3 and 6(B), the length of the phase shifter is somewhat long in the direction perpendicular to the longitudinal direction thereof. However, the longitudinal length of the phase shifter is reduced from that of prior art devices. Furthermore, in this phase shifter, the reflection characteristics are markedly improved.

Figure 5:
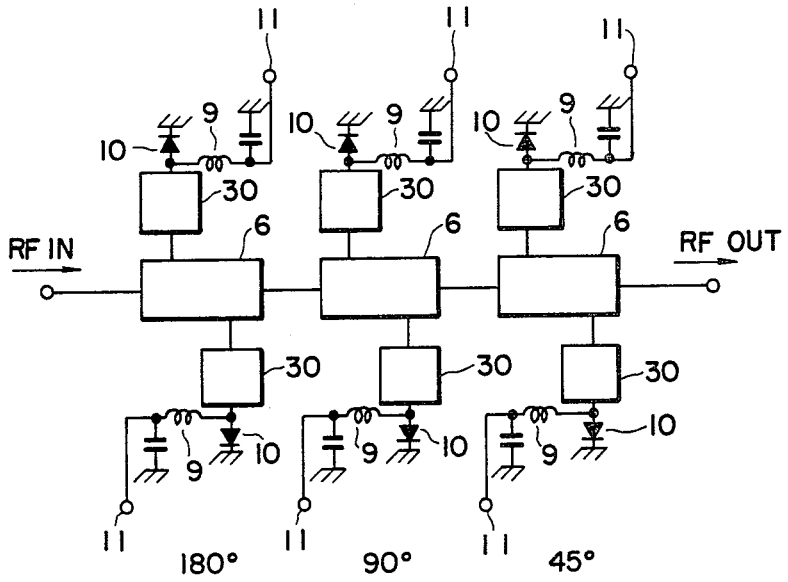
FIG. 5 is a block schematic diagram showing a second example of the stripline diode phase shifter according to the invention.

A second example of the stripline diode phase shifter will be described with reference to FIGS. 5 and 6(C) which show a phase shifter construction adapted for miniaturization and line loss reduction. As shown in FIG. 5, a coupling line 30, including a diode loading line section 21 and a λ/4 impedance conversion coupling line section 22 as shown in FIG. 6(C), is connected between each hybrid 6 and each PIN diode 10. The characteristic impedance of the λ/4 impedance conversion coupling line section 22 can be varied by suitably varying the coupling line interval, and the coupling line width. Accordingly, similarly as in a conventional diode loading line 8, a desired amount of phase shift can be obtained by suitably designing the λ/4 impedance conversion coupling line section 22 in accordance with the impedance characteristics of the PIN diode 10. It goes without saying that the coupling line 30 separates the hybrid 6 from the PIN diode 10 in a sense of direct current, thus serving as the DC cut.

As is clear from the above description, the coupling line 30 functions both as the DC cut and the diode loading line. Therefore, the length of the line connecting the hybrid 6 to the PIN diode 10 can be decreased. Accordingly, the propagation loss is reduced, and the size of the stripline diode phase shifter can be minimized as to make it appropriate as a beam operating element such as for use in a satellite multi-beam antenna.

In summary, in the second example of a stripline diode phase shifter of the invention, each hybrid 6 is coupled through each coupling line 30 to each PIN diode 10 whereby the propagation loss is reduced and the size of the overall device is also decreased.

What is claimed is:

1. A stripline diode phase shifter of the type comprising: at least one hybrid coupler having an input port, an output port and at least one phase shifting port; at least one phase shifting diode coupled to said at least one phast shifting port; and biasing means for applying a DC bias voltage to said at least one diode to control the phase of the signal at said output port, the improvement comprising:

said at least one diode being coupled to said at least one phase shifting port via coupling line-type coupling means for coupling RF energy from said at least one phase shifting port to said at least one phase shifting diode while isolating said at least one phase shifting port from said DC bias voltage;

said hybrid coupler being of the type comprising a dielectric having first and second surfaces, a first hybrid coupling line conductor printed on said first surface and a second hybrid coupling line conductor printed on said second surface; and said coupling line-type coupling means comprising a first coupling conductor connected to one of said first and second hybrid coupling line conductors and disposed on the same surface as the hybrid coupling line conductor to which it is connected, and a second coupling conductor juxtaposed with said first coupling conductor on the opposite surface of said dielectric and coupled to said at least one diode.

2. A stripline diode phase shifter as defined in claim 1, wherein said second coupling conductor is coupled to said at least one diode through a diode loading circuit comprising a $\lambda/4$ impedance conversion line and a diode loading line.

3. A stripline diode phase shifter as defined in claim 1, wherein said second coupling conductor comprises a $\lambda/4$ impedance conversion line and is coupled to said diode through a diode loading line.

4. A stripline diode phase shifter as defined in any one of claims 1, 2 or 3, wherein said phase shifter is a multi-bit phase shifter further comprising at least a second hybrid coupler having its first and second hybrid coupling line conductors printed on said second and first dielectric surfaces, respectively, the output port of said first hybrid coupler being connected to the input port of said second hybrid coupler to form a single conductor on the same side of said dielectric.

5. A multi-bit stripline diode phase shifter as defined in claim 4, wherein said phase shifter includes a plurality of hybrid couplers each of which includes first and second hybrid coupling line conductors, said at least one diode comprising first and second diodes coupled to respective first and second hybrid coupling line conductors in each of said hybrid couplers, at least one of the first and second diodes being coupled to its respective hybrid coupling line conductor through said coupling line-type coupling means.

* * * * *